US006940336B2

(12) United States Patent
Bakker

(10) Patent No.: US 6,940,336 B2
(45) Date of Patent: Sep. 6, 2005

(54) VOLTAGE REGULATOR WITH SWITCH-ON PROTECTION CIRCUIT

(75) Inventor: Peter Bakker, Munich (DE)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 10/695,334

(22) Filed: Oct. 28, 2003

(65) Prior Publication Data

US 2004/0135623 A1 Jul. 15, 2004

(30) Foreign Application Priority Data

Nov. 28, 2002 (DE) ..... 102 55 582

(51) Int. Cl.[7] ..... G05F 1/10; G05F 3/02
(52) U.S. Cl. ..... 327/541; 323/280
(58) Field of Search ..... 327/530, 540, 327/541, 543, 538; 323/280

(56) References Cited

U.S. PATENT DOCUMENTS 6,628,489 B1 * 9/2003 Pardoen et al. ..... 361/84
6,801,419 B2 * 10/2004 Fukui ..... 361/93.1

* cited by examiner

*Primary Examiner*—Quan Tra
(74) *Attorney, Agent, or Firm*—W. Daniel Swayze, Jr.; W. James Brady; Frederick J. Telecky, Jr.

(57) ABSTRACT

Voltage regulator with an output transistor MP1, including a first PMOS FET, whereby the input voltage Vdd of the voltage regulator is applied to the source of the output transistor MP1 and where the drain of the output transistor MP1 constitutes the output of the voltage regulator. The voltage regulator, furthermore, includes a regulation circuit 1 that may, for example, consist of an error amplifier and that controls the output transistor in such a way that the least possible deviations between the output voltage Vout and the target output voltage are allowed to occur. The voltage regulator includes a switch-on protection circuit that includes a second PMOS FET MP2, whereby the source of the second PMOS FET MP2 is connected to the input voltage Vdd of the voltage regulator, the drain of the second PMOS FET MP2, by way of a pulldown resistor R3, to a reference potential Vss, and the gate of the second PMOS FET MP2 to the reference potential Vss, and which furthermore includes a third PMOS FET MP3, where the source of the third PMOS FET MP3 is connected to the input voltage Vdd of the voltage regulator, the drain of the third PMOS FET MP3 is connected to the gate of the output transistor MP1, and the gate of the third PMOS FET MP3 is connected to the drain of the second PMOS FET MP2.

12 Claims, 4 Drawing Sheets

(State of the Art)

(State of the Art)

VOLTAGE REGULATOR WITH SWITCH-ON PROTECTION CIRCUIT

RELATED APPLICATION

The present application is based on priority of German Patent Application No. 102 55 582.6, filed on Nov. 28, 2002.

FIELD OF THE INVENTION

The invention relates to a voltage regulator with switch-on protection circuit.

SUMMARY OF THE INVENTION

The operation of a plurality of electronic circuits requires voltage regulators that transform the voltage provided by a power supply into a voltage suited to the circuit concerned, and so to supply the circuit with power.

Different voltage regulators according to the technological state of the art are known. In the textbook "Elektronik" by Dieter Zastrow, Friedrich Vieweg & Sohn Verlagsgesellschaft mbH, Braunschweig/Wiesbaden, 5th edition, 1999, for example, on page 232 a voltage regulator with an operational amplifier is described, which is also known as an error amplifier. This error amplifier compares at its inputs a reference voltage, defining the target output voltage, with a voltage derived from the actual output voltage of the voltage regulator, by way of a voltage divider. The error signal produced at the output of the error amplifier, which defines the deviation of the actual output voltage of the voltage regulator from the target output voltage of the voltage regulator, controls an output transistor in a way that the actual output voltage of the voltage transformer follows its target output voltage.

If a PMOS FET is used as output transistor, which may be necessary if the voltage differences between the input voltage Vdd of the voltage regulator and the target output voltage are very small, the circuit structure represented in FIG. 1 results. When switching on a voltage regulator with such a circuit structure, that is when raising the input voltage Vdd from 0 volts to its final value, there will be the problem that very heavy overshooting of the actual output voltage with respect to the target output voltage may occur, which is represented in exemplified form in FIG. 4*a,* where the output voltage of the voltage regulator is plotted against time whilst the input voltage rises. In FIG. 4, the output voltage briefly exceeds the target value of the output voltage (2 volts) by approximately 1 volt when switching on. When circuit elements (such as CMOS circuit elements) are connected to the output (Vout) of the voltage regulator, which are very sensitive to over-voltage, these circuit elements may suffer damage or even destruction when the voltage regulator is switched on. Excess voltage levels may furthermore reduce the useful life of the circuit elements.

The objects of the invention is, therefore, the provision of a voltage regulator with an output transistor, consisting of a PMOS FET, and a simply-configured yet effective switch-on protection circuit, whereby the danger of damage to the circuit elements connected to the output of the voltage regulator is considerably reduced at the time of switching the voltage regulator on, that is when the input voltage rises.

This object is achieved by means of a voltage regulator with an output transistor, including of a first PMOS FET, whereby the input voltage of the voltage regulator is applied to the source of the output transistor and where the drain of the output transistor constitutes the output of the voltage regulator, a regulation circuit that is configured so as to output an error signal representing the deviation of the actual output voltage of the voltage regulator from the target output voltage of the voltage regulator at its output, whereby the output of the regulating means is connected to the gate of the output transistor, which is controlled by the error signal in such a way that the least possible deviations occur between the output voltage and the target output voltage, as well as a switch-on protection circuit, comprising a second PMOS FET, whereby the source of the second PMOS FET is connected to the input voltage of the voltage regulator, the drain of the second PMOS FET by way of a pull-down resistor to the reference potential, and the gate of the second PMOS FET to the reference potential, and which furthermore includes a third PMOS FET, where the source of the third PMOS FET is connected to the input voltage of the voltage regulator, the drain of the third PMOS FET is connected to the gate of the output transistor, and the gate of the third PMOS FET is connected to the drain of the second PMOS FET.

The switch-on protection circuit of the voltage regulator is embodied in a particularly simple and therefore cost-effective way. In its simplest form, only two further PMOS FETs and a pull-down resistor are required. At first, one PMOS FET briefly blocks the output transistor whilst the input voltage rises, whilst the other PMOS FET, after a certain time lapse, causes the other PMOS FET once more to enable the output transistor. The switch-on protection circuit is embodied in a very simple configuration and requires no complex circuit elements, such as comparators, etc.

Advantageous further developments of the invention are characterized in the sub-claims.

BRIEF DESCRIPTION OF THE DRAWINGS

The invention shall now be explained, in exemplified form, with reference to the drawing where.

DETAILED DESCRIPTION OF THE DRAWINGS

Figure 1:
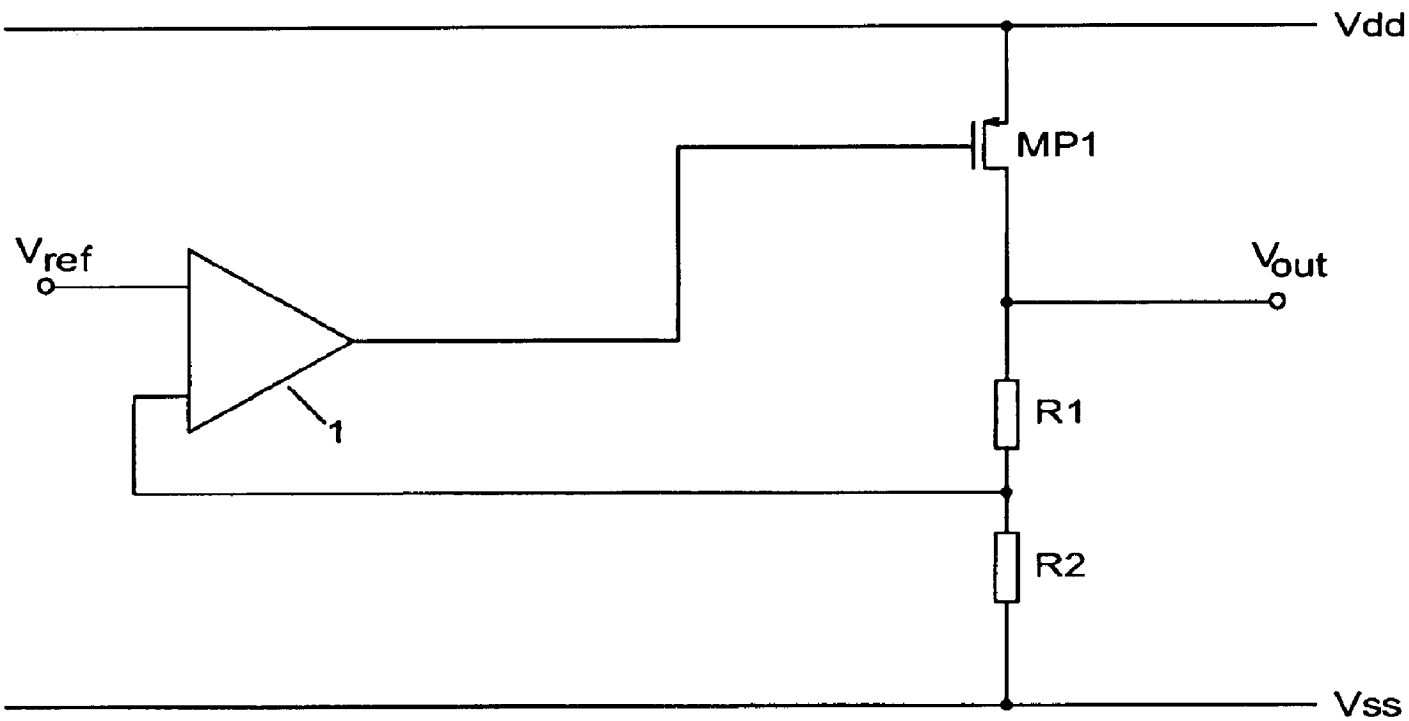
FIG. 1 is the circuit diagram of a voltage regulator, in accordance with state-of-the-art technology.
Figure 2:
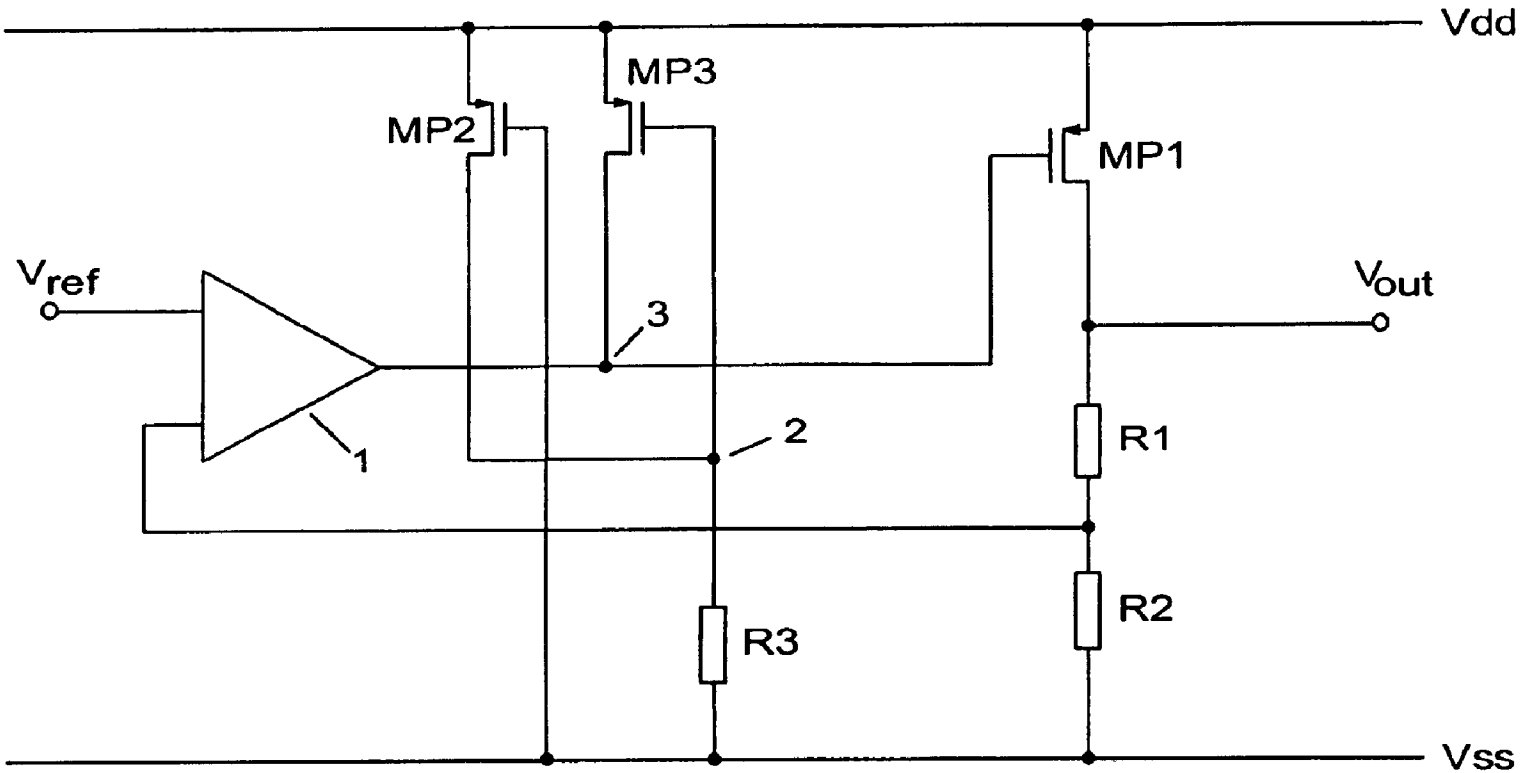
FIG. 2 shows a first embodiment form of a voltage regulator with switch-on protection circuit according to the invention.

FIG. 2 represents the circuit diagram of a first embodiment version of a voltage regulator with input protection circuit according to the invention. The structure of this circuit shall be described in the following:

In the first instance, the circuit comprises an output transistor MP1, which includes a PMOS FET. The input voltage Vdd of the voltage regulator, which should be at a minimum of 2.25 volts in the present example, is connected to the source of the PMOS FET MP1. The drain of the PMOS FET MP1 is connected to the output of the voltage regulator, at which the regulated output voltage Vout is present. The output may, for example, be connected to an electronic device that may, for example, includes voltage-sensitive components, such as CMOS circuit elements.

The output transistor MP1 is controlled by an operational amplifier 1, is an error amplifier, whose output is connected to the gate of the output transistor MP1. A reference voltage Vref is applied to one input of the error amplifier 1, which may, for example, be generated by a band gap reference voltage generating circuit and which determines the target value of the output voltage of the voltage regulator, which in the present example is around 1.8 volts. The other input of the error amplifier receives a signal that is derived from the actual output voltage Vout of the voltage regulator by way of the voltage divider consisting of the resistors R1 and R2, and which represents the present value of the output voltage Vout. A signal is generated at the output of the error amplifier that represents the deviation between the target output voltage and the actual output voltage, and that serves to control the output transistor MP1 during the normal operation of the voltage regulator, that is outside the switch-on mode cycle, with a view to reducing any differences between the target and the actual voltage values. "Switch-on" here is to mean the increase of the input voltage Vdd from 0 volts to its final value.

Figure 4A:
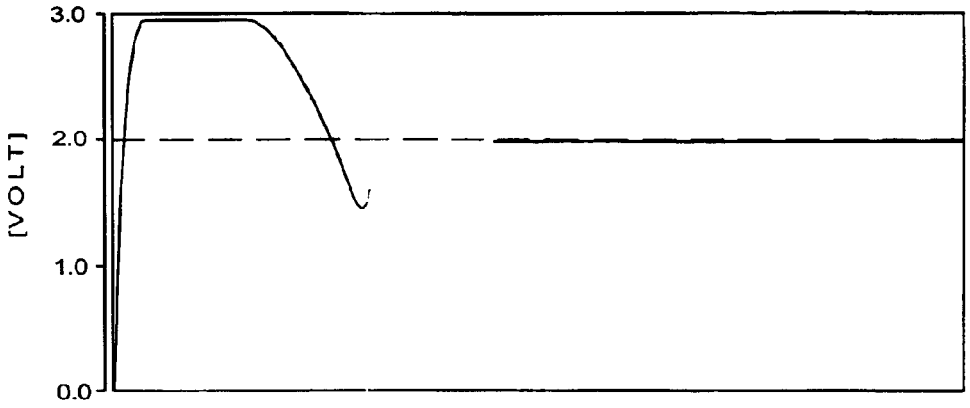
FIG. 4*a* shows a graph plotting the output voltage of the voltage regulator represented in FIG. 1 over the switch-on time period of the voltage regulator.

The voltage regulator represented in FIG. 2 furthermore includes a switch-on protection circuit, which serves to protect the output of the circuit, as well as the overvoltage-sensitive circuit elements connected to the output, from excess voltage surges that could be produced by overshoots whilst the input voltage Vdd rises from 0 volts to 2.25 volts (see FIG. 4*a* in this connection).

The switch-on protection circuit is of very simple structure and requires no complex circuit elements, such as comparators, etc. It consists of the two PMOS FETs MP2 and MP3, and the resistor R3.

The source of the second PMOS FET MP2 is here connected to the input voltage Vdd of the voltage regulator. The drain of the second PMOS FET MP2 is connected to the gate of the third PMOS FET MP3 at the circuit junction 2. The gate of the second PMOS FET MP2 is connected to a reference potential Vss, which in the present case means the ground potential. The source of the third PMOS FET MP3 is also connected to the input voltage Vdd of the voltage regulator. The drain of the third PMOS FET MP3 is connected to the output of the error amplifier 1 via the circuit junction 3. The resistor R3, which acts as a pulldown resistor, is connected between the circuit junction 2 and ground (Vss).

The mode of operation of the circuit, represented in FIG. 2, during the rising phase of the input voltage Vdd, shall now be described.

Initially, the case shall be considered where the input voltage Vdd=Vss=0 volts. In this case the voltage Vss=0 volts is present both at the gate and at the source of the second PMOS FET MP2, so that the value of the gate-source voltage does not reach the value of the threshold voltage and MP2 is in its off-state, since its gate is pulled to ground potential by the pull-down resistor R3, and the source is also at ground potential. The output Vout of the circuit therefore is at ground potential Vss.

When the voltage regulator is now switched on, and the input voltage Vdd rises, the situation described in the previous paragraph does not change as long as the input voltage Vdd stays below the threshold value of both the PMOS FETs MP2 and MP3, whereby it is assumed that the threshold voltage values of the two PMOS FETs are identical.

However, once the rising input voltage Vdd exceeds the threshold voltage of both the PMOS FETs MP2 and MP3, the second PMOS FET MP2 goes into its on-state, since the value of the gate-source voltage now exceeds the value of the threshold voltage. At the same time, the third PMOS FET MP3 also goes into its on-state, since its threshold voltage value is also exceeded. Because the third PMOS FET MP3 is now in its on-state, the voltage present at the second circuit junction 3, as marked in FIG. 2, is pulled up to Vdd potential. This charges the gate of the output transistor MP1 to Vdd potential, so that the output transistor MP1 for the time being remains in its off-state, since the value of the gate-source voltage applied to it (Vdd is also present at its source) does not reach its threshold voltage. The regulation of the output voltage Vout by way of the output of the error amplifier is therefore initially deactivated.

Since the second PMOS FET MP2 has been taken into its on-state, the first circuit junction 2 and, therefore the gate capacitance of the third PMOS FET MP3, will be slowly charged up to Vdd potential, whereby this effect is stronger than the effect of the pull-down resistor R3. Once this process is completed after a certain short time span, which will, however, be short enough to prevent any overshoot during the switch-on phase of the voltage regulator, the third PMOS FET MP3 once again goes into its off-state, since the value of the gate-source voltage once more falls below the threshold voltage. This in turn again enables the output transistor MP1, whose gate voltage is now determined by the output signal present at the output of the error amplifier 1. The switch-on mode is now terminated, and normal operation of the voltage regulator once again commences.

Figure 3:
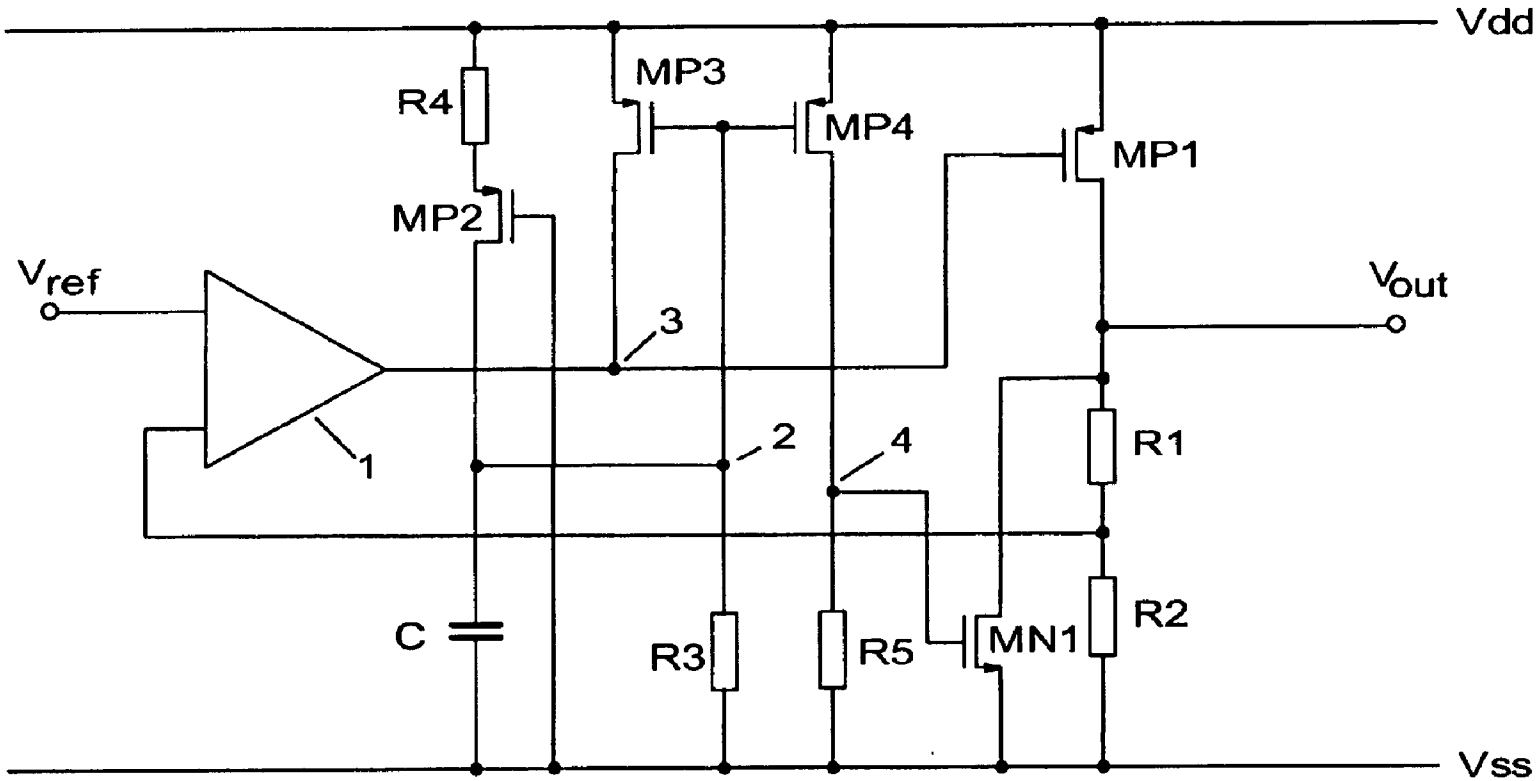
FIG. 3 represents a second embodiment form of a voltage regulator with switch-on protection circuit according to the invention.

A further embodiment form of the voltage regulator according to the invention is shown in FIG. 3, which represents a further development of the embodiment form represented in FIG. 2, so that only the differences shall be explained.

The switch-on protection circuit in the embodiment form represented in FIG. 3 furthermore comprises an RC combination, which consists of the resistor R4 and the capacitor C. The resistor is connected between the input voltage Vdd and the source of the second PMOS FET MP2, whilst the capacitor C is connected between the drain of the second PMOS FET MP2 and ground. The RC combination serves to determine the time during which the switch-on protection circuit shall be effective, since the time constant (determined by R4*C) determines the speed at which the circuit junction 2 and the gate capacitance of the third PMOS FET MP3 will invert their potential, once the input voltage Vdd has exceeded the threshold voltage of the PMOS FETs MP2 and MP3.

The switch-on protection circuit represented in FIG. 3 furthermore includes an element that serves to ensure that, during the time when the input protection circuit is operational, the output Vout of the voltage regulator remains at ground potential and any floating of the output voltage is prevented. This element includes of the NMOS FET MN1, the resistor R5, as well as the fourth PMOS FET MP4.

The fourth PMOS FET MP4 and the third PMOS FET MP3 together form a simultaneous switch. The source of the fourth PMOS FET MP4 is connected to the input voltage Vdd. The drain of the fourth PMOS FET MP4 is connected to ground potential Vss by way of the resistor R5. The gate of the fourth PMOS FET MP4 is connected to the gate of the third PMOS FET MP3. The drain of the NMOS FET MN1 is connected to the output Vout of the voltage regulator. The source of the NMOS FET MN1 is connected to ground, and its gate is connected to the drain of the fourth PMOS FET MP4.

As long as the third PMOS FET MP3 is in its on-state during the rising phase of the input voltage Vdd and the operation of the switch-on protection circuit, the fourth PMOS FET MP4 is also in its on-state. During this time, the fourth PMOS FET MP4 pulls the voltage at the gate of the NMOS FET MN1 up to Vdd potential, causing this to go into its on-state. As a result, the output Vout of the voltage regulator is pulled down to ground potential and so is prevented from being in a floating condition at an undefined voltage level. As soon as the circuit junction 2 is charged up by way of the second PMOS FET MP2 and the RC combination R4 and C, the fourth PMOS FET MP4, and therefore the NMOS FET MN1 will also be in their off-state, and the output Vout of the voltage regulator will again be released.

In all other respects, however, the operation of the circuit represented in FIG. 3 is exactly the same as that of the circuit represented in FIG. 2, so that reference shall be made to the above description.

Figure 4B:
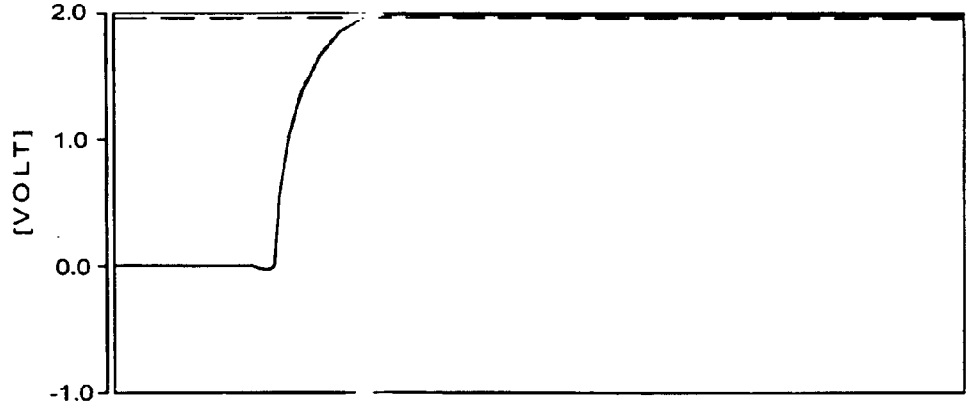
FIG. 4*b* shows a graph plotting the output voltage of the voltage regulator according to the invention represented in FIG. 3 over the switch-on time period of the voltage regulator.

FIG. 4*b* represents the curve of the output voltage Vout of a voltage regulator represented in FIG. 3 over the time when the voltage regulator is switched on, that is when the input voltage Vdd is rising. It can be clearly appreciated that, in contrast to voltage regulators known according to the technological state of the art (see FIG. 4*a*), any overshooting of the output voltage above the target voltage value of 2 volts is avoided, and any voltage-sensitive circuit elements connected to the output of the voltage regulator are therefore protected.

It should be mentioned that all the MOS FETs used in the circuits represented in either FIG. 2 or FIG. 3 revert to their off-state by default.

The embodiment forms of the voltage regulator with switch-on protection circuit according to the invention, represented by way of examples, can be modified in a plurality of ways. The operational amplifier 1, for example, may be replaced by other means. It is only necessary that the regulation means is embodied in such a way that it can generate at its output an error signal representing the deviation of the actual output voltage from the target voltage, whereby the output of the regulation means is connected to the gate of the output transistor, which is controlled by the error signal so that any deviations of the output voltage Vout from the target output voltage will remain as small as possible.

What is claimed is:

1. Voltage regulator with an output transistor (MP1) of a first PMOS FET, comprising:

said first PMOS FET, whereby the input voltage (Vdd) of the voltage regulator is applied to the source of the output transistor (MP1) and where the drain of the output transistor (MP1) serves as the output of the voltage regulator, a regulation circuit (1) that is configured so as to output an error signal representing the deviation of the actual output voltage (Vout) of the voltage regulator from the target output voltage of the voltage regulator at its output, the output of the regulating circuit (1) being connected to the gate of the output transistor (MP1), which is controlled by the error signal in such a way that any deviations between the output voltage (Vout) and the target output voltage are minimized, as well as a switch-on protection circuit, a second PMOS FET (MP2), the source of the second PMOS FET (MP2) being connected to the input voltage (Vdd) of the voltage regulator, the drain of the second PMOS FET (MP2) by way of a pulldown resistor R3) to a reference potential (Vss), and the gate of the second PMOS FET (MP2) to the reference potential (Vss), and a third PMOS FET (MP3), where the source of the third PMOS FET (MP3) is connected to the input voltage (Vdd) of the voltage regulator, the drain of the third PMOS FET (MP3) is connected to the gate of the output transistor (MP1), and the gate of the third PMOS FET (MP3) is connected to the drain of the second PMOS FET (MP2).

2. Voltage regulator according to claim 1, wherein the regulation circuit is compares a reference voltage (Vref), which defines the target output voltage of the voltage regulator, with a voltage that represents the actual output voltage (Vout) of the voltage regulator.

3. Voltage regulator according to claim 2, wherein the regulation circuit (1) is an operational amplifier.

4. Voltage regulator according to claim 1, wherein the reference potential (Vss) is the ground potential.

5. Voltage regulator according to claim 1, wherein the voltage representing the actual output voltage (Vout) is derived from the output voltage (Vout) by way of a voltage divider (R1, R2).

6. Voltage regulator according to claim 1, where the switch-on protection circuit furthermore comprises an RC combination that is connected to the source-drain path of the second PMOS FET (MP2).

7. Voltage regulator according to claim 6, where the capacitor (C) of the RC combination is connected between the drain of the second PMOS FET (MP2) and the reference potential Vss), and the resistor (R4) of the RC combination is connected between the input voltage Vdd) of the voltage regulator and the source of the second PMOS FET (MP2).

8. Voltage regulator according to claim 1, where the switch-on protection circuit furthermore comprises an NMOS FET (MN1) that is connected so as to force the output voltage (Vout) of the voltage regulator to assume the reference potential (Vss) whilst the voltage regulator is switched on.

9. Voltage regulator according to claim 8, where the source of the NMOS FET (MN1) is connected to the reference potential (Vss), the drain of the NMOS FET (MN1) to the output of the voltage regulator, and the gate of the NMOS FET (MN1) is connected to the reference potential by way of a further pull-down resistor (R5), whereby the switch-on protection circuit furthermore comprises a fourth PMOS FET (MP4) that is connected so as to form a simultaneous switch together with the third PMOS FET (MP3), and whereby the drain of the fourth PMOS FET (MP4) is connected to the gate of the NMOS FET (MN1).

10. Voltage regulator according to claim 1, whereby the input voltage shall be approximately 2.25 volts, and the target output voltage approximately 1.8 volts.

11. Voltage regulator according to claim 1, whereby the level of the input voltage (Vdd) is raised from 0 volts when the voltage regulator is switched on.

12. Voltage regulator according to claim 1, which is embodied in the form of an integrated circuit.

* * * * *